US011821132B2

(12) United States Patent
Zhao et al.

(10) Patent No.: US 11,821,132 B2
(45) Date of Patent: Nov. 21, 2023

(54) CLOTHES TREATMENT AGENT RELEASE DEVICE, WASHING MACHINE AND CONTROL METHOD THEREFOR

(71) Applicants: QINGDAO JIAONAN HAIER WASHING MACHINE CO., LTD., Shandong (CN); HAIER SMART HOME CO., LTD., Shandong (CN)

(72) Inventors: Zhiqiang Zhao, Shandong (CN); Peishi Lv, Shandong (CN); Sheng Xu, Shandong (CN)

(73) Assignees: QINGDAO JIAONAH HAIER WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 143 days.

(21) Appl. No.: 17/294,340

(22) PCT Filed: Nov. 15, 2019

(86) PCT No.: PCT/CN2019/118684
§ 371 (c)(1),
(2) Date: May 14, 2021

(87) PCT Pub. No.: WO2020/098767
PCT Pub. Date: May 22, 2020

(65) Prior Publication Data

US 2022/0010475 A1 Jan. 13, 2022

(30) Foreign Application Priority Data

Nov. 15, 2018 (CN) ..... 201811360945.9

(51) Int. Cl.
*D06F 39/02* (2006.01)
*D06F 39/08* (2006.01)
(Continued)

(52) U.S. Cl.
CPC ..... *D06F 39/022* (2013.01); *D06F 33/37* (2020.02); *D06F 39/02* (2013.01); *D06F 39/028* (2013.01);
(Continued)

(58) Field of Classification Search
CPC ..... D06F 33/37; D06F 33/57; D06F 39/02; D06F 39/022; D06F 39/028; D06F 39/08; D06F 2105/42
See application file for complete search history.

(56) References Cited

U.S. PATENT DOCUMENTS 4,141,467 A * 2/1979 Augustijn ..... F04B 9/1035 137/99
2018/0135228 A1* 5/2018 Haberlander ..... D06F 39/022
(Continued)

FOREIGN PATENT DOCUMENTS

CN 101016690 A 8/2007
CN 202644207 U 1/2013
(Continued)

OTHER PUBLICATIONS

Machine translation of CN 206359787 U. (Year: 2017).*
(Continued)

*Primary Examiner* — Joseph L. Perrin
(74) *Attorney, Agent, or Firm* — BUCHANAN INGERSOLL & ROONEY PC

(57) ABSTRACT

A clothes treatment agent release device includes: a storage cavity in which a clothes treatment agent is stored; a release cavity with a liquid outlet and a liquid inlet communicating with the storage cavity, a one-way turn-on part arranged at the liquid inlet, and a one-way turn-on part being at the liquid outlet; a reciprocating piston in the release cavity; and a driving mechanism to drive the piston mechanism, the liquid inlet turn-on part/the liquid outlet turn-on part respec-
(Continued)

tively and unidirectionally turn on the liquid inlet/the liquid outlet in the reciprocating motion of the piston mechanism. The clothes treatment agent in the storage cavity is sucked into the release cavity from the liquid inlet, and is discharged and released from the liquid outlet.

5 Claims, 2 Drawing Sheets

(51) Int. Cl.
*D06F 33/37* (2020.01)
*D06F 105/42* (2020.01)
*D06F 33/57* (2020.01)

(52) U.S. Cl.
CPC ..... *D06F 39/08* (2013.01); *D06F 33/57* (2020.02); *D06F 2105/42* (2020.02)

(56) References Cited

U.S. PATENT DOCUMENTS

| | | | | |
|---|---|---|---|---|
| 2018/0220865 | A1* | 8/2018 | Schaumann | A47L 15/4297 |
| 2021/0102330 | A1* | 4/2021 | Zhao | D06F 39/02 |

FOREIGN PATENT DOCUMENTS

| | | | | | |
|---|---|---|---|---|---|
| CN | 202849806 | U | | 4/2013 | |
| CN | 203334043 | U | | 12/2013 | |
| CN | 203373569 | U | | 1/2014 | |
| CN | 204753178 | U | | 11/2015 | |
| CN | 205152630 | U | | 4/2016 | |
| CN | 106436136 | A | | 2/2017 | |
| CN | 206359787 | U | | 7/2017 | |
| CN | 207091748 | U | | 3/2018 | |
| JP | H01232995 | A | | 9/1989 | |
| JP | 2006110362 | A | | 4/2006 | |
| KR | 20220046837 | A | * | 4/2022 | D06F 39/022 |
| WO | 2017123173 | A1 | | 7/2017 | |
| WO | 2018141217 | A1 | | 8/2018 | |

OTHER PUBLICATIONS

International Search Report (PCT/ISA/210) with translation and Written Opinion (PCT/ISA/237) dated Feb. 19, 2020, by the China National Intellectual Property Administration (ISA/CN) as the International Searching Authority for International Application No. PCT/CN2019/118684. (10 pages).
Notice of Reasons for Refusal issued in Japanese Application No. 2021-522514; dated Nov. 1, 2022. 9 Pages (with Translation).
Office Action issued Chinese Application No. 201811360945.9; dated Jul. 29, 2021; 12 paged including English Translation.

* cited by examiner

CLOTHES TREATMENT AGENT RELEASE DEVICE, WASHING MACHINE AND CONTROL METHOD THEREFOR

TECHNICAL FIELD

The present disclosure relates to the technical field of detergent release of a washing machine, and particularly relates to a clothes treatment agent release device, a washing machine and a control method thereof.

BACKGROUND

A washing machine serves as the most common household appliance in people's daily life, and with continuous development and progress of technologies, research and development of the washing machine increasingly pay attention to promoting the use experience of a user on the basis of meeting the basic laundry requirements of people. More and more washing machines have an automatic detergent release function, so that the user does not need to manually add a detergent when using the washing machine for washing clothes, thereby greatly facilitating use of the user and promoting the use experience of the user.

The automatic detergent adding mode of an existing washing machine generally adopts a venturi principle to add the detergent, the pressure is changed due to the change of the diameter of a water inlet pipe, then a certain negative pressure can be formed to suck the detergent to be added into the water inlet pipe, and the detergent is driven by inflow water to be relatively uniformly added into a washing outer tub of the washing machine. Such automatic detergent release mode has a certain requirements on design and assembly of a structure, and is relatively complex in structure and high in cost in the implementing process. In addition, some other washing machines adopt a gear pump, a peristaltic pump and a piston pump in a motor driven form to carry out release, and in this mode, a motor and a pump need to be additionally added, resulting in high cost, and incapability of accurate quantitative release.

In view of this, the present disclosure mainly solves the problems of insufficient accuracy of automatic detergent addition and poor multi-detergent release performance of the existing washing machine, and provides a release device which adopts an optimized principle and is simpler, more convenient and more feasible in actual operation and can accurately and quantitatively add various detergents and care agents with different functions.

SUMMARY

In order to solve the above problems, a first inventive objective of the present disclosure is to provide a clothes treatment agent release device, and specifically, the following technical solution is adopted.

The clothes treatment agent release device includes:

a storage cavity in which a clothes treatment agent is stored;

a release cavity provided with a liquid outlet and a liquid inlet communicating with the storage cavity, a liquid inlet one-way turn-on part being arranged at the liquid inlet, and a liquid outlet one-way turn-on part being arranged at the liquid outlet;

a piston mechanism arranged in the release cavity in a reciprocating motion mode; and a driving mechanism connected with the piston mechanism; wherein the driving mechanism drives the piston mechanism to do reciprocating motion in the release cavity, the liquid inlet one-way turn-on part/the liquid outlet one-way turn-on part respectively and unidirectionally turns on the liquid inlet/the liquid outlet in the reciprocating motion process of the piston mechanism, and the clothes treatment agent in the storage cavity is sucked into the release cavity from the liquid inlet, and discharged and released from the liquid outlet.

Further, the piston mechanism includes a piston and a piston rod;

the driving mechanism includes a driving part and a driven part, the driven part is respectively in transmission connection with the driving part and the piston rod, and the driven part converts rotation of the driving part into the reciprocating motion of the piston in the release cavity; or, the driving mechanism is provided with a driving end capable of reciprocating motion, and the driving end is connected with the piston rod to drive the piston to do reciprocating motion in the release cavity.

Further, the driven part includes a driven wheel, one end of the piston rod of the piston mechanism is eccentrically and rotatably connected with the driven wheel, the other end of the piston rod of the piston mechanism is connected with the piston, the driving part drives the driven wheel to rotate, and the driven wheel drives the piston to do reciprocating motion in the release cavity by the piston rod; and the driving part is provided with a rotating end, and the rotating end is connected with the driven wheel to drive the driven wheel to rotate; or the driving part includes a driving motor and a driving gear connected with the driving motor, the driven wheel is a driven gear, and the driving gear is in engaged transmission with the driven gear.

Further, the release cavity includes a first release cavity for releasing one type of clothes treatment agent and a second release cavity for releasing another type of clothes treatment agent, a first piston mechanism is arranged in the first release cavity, and a second piston mechanism is arranged in the second release cavity; the driven part includes a first driven part in transmission connection with the first piston mechanism and a second driven part in transmission connection with the second piston mechanism; and the driving part is optionally in transmission connection with the first driven part or the second driven part to release the clothes treatment agent in the first release cavity or the second release cavity.

Further, the driving part includes the driving motor and the driving gear connected with the driving motor, the first driven part includes a first driven gear, the second driven part includes a second driven gear, one end of a piston rod of the first piston mechanism is eccentrically and rotatably connected with the first driven gear, and one end of a piston rod of the second piston mechanism is eccentrically and rotatably connected with the second driven gear; and the driving gear can move to be in engaged transmission with the first driven gear or in engaged transmission with the second driven gear so as to release the clothes treatment agent in the first release cavity or the second release cavity.

Further, the first driven gear and the second driven gear are arranged at intervals in a horizontal direction, and arranged up and down in a vertical direction; and the driving gear is arranged in an up-and-down movable mode between the first driven gear and the second driven gear, and the driving gear moves up and down to be respectively in engaged transmission with the first driven gear and the second driven gear.

Further, a connection screw is arranged at an output end of the driving motor, the center of the driving gear is provided with a threaded hole in threaded connection with the connection screw, and the connection screw drives the driving gear to move up and down in the vertical direction to be respectively in engaged transmission with the first driven gear and the second driven gear.

Further, the clothes treatment agent release device includes a shell; the shell is internally provided the first release cavity, the second release cavity and a mounting cavity, the driving part, the first driven gear and the second driven gear are arranged in the mounting cavity, and one end of the piston rod of the first piston mechanism is connected with a piston, and the other end of the piston rod of the first piston mechanism extends into the mounting cavity to be eccentrically and rotatably connected with the first driven gear; one end of the piston rod of the second piston mechanism is connected with a piston, and the other end of the piston rod of the second piston mechanism extends into the mounting cavity to be eccentrically and rotatably connected with the second driven gear; the first release cavity is provided with a first liquid inlet and a first liquid outlet, a first liquid inlet one-way valve is arranged at the first liquid inlet, and a first liquid outlet one-way valve is arranged at the first liquid outlet; and the second release cavity is provided with a second liquid inlet and a second liquid outlet, a second liquid inlet one-way valve is arranged at the second liquid inlet, and a second liquid outlet one-way valve is arranged at the second liquid outlet.

A second inventive objective of the present disclosure is to provide a washing machine, and specifically, the following technical solution is adopted.

A washing machine with the clothes treatment agent release device includes a detergent box, wherein the liquid outlet of the clothes treatment agent release device communicates with the detergent box.

A third inventive objective of the present disclosure is to provide a control method of a washing machine, and specifically, the following technical solution is adopted.

The control method of the washing machine includes:

in a water inflow process of the washing machine, controlling a driving mechanism to drive a piston mechanism to do reciprocating motion in a release cavity, respectively and unidirectionally turning on a liquid inlet/a liquid outlet in the reciprocating motion process of the piston mechanism by a liquid inlet one-way turn-on part/a liquid outlet one-way turn-on part, sucking a clothes treatment agent in a storage cavity into the release cavity from the liquid inlet, and discharging and releasing the clothes treatment agent from the liquid outlet.

The clothes treatment agent release device provided by the present disclosure drives the piston mechanism to do reciprocating motion in the release cavity by the driving mechanism so as to release the clothes treatment agent in the release cavity, adopts a principle different from that of an existing automatic detergent release device, is simple in structure and low in cost, promotes user experience, and has a wide market prospect.

DETAILED DESCRIPTION

A clothes treatment agent release device, a washing machine and a control method thereof of the present disclosure will be described in detail below in connection with the accompanying drawings.

Figure 1:
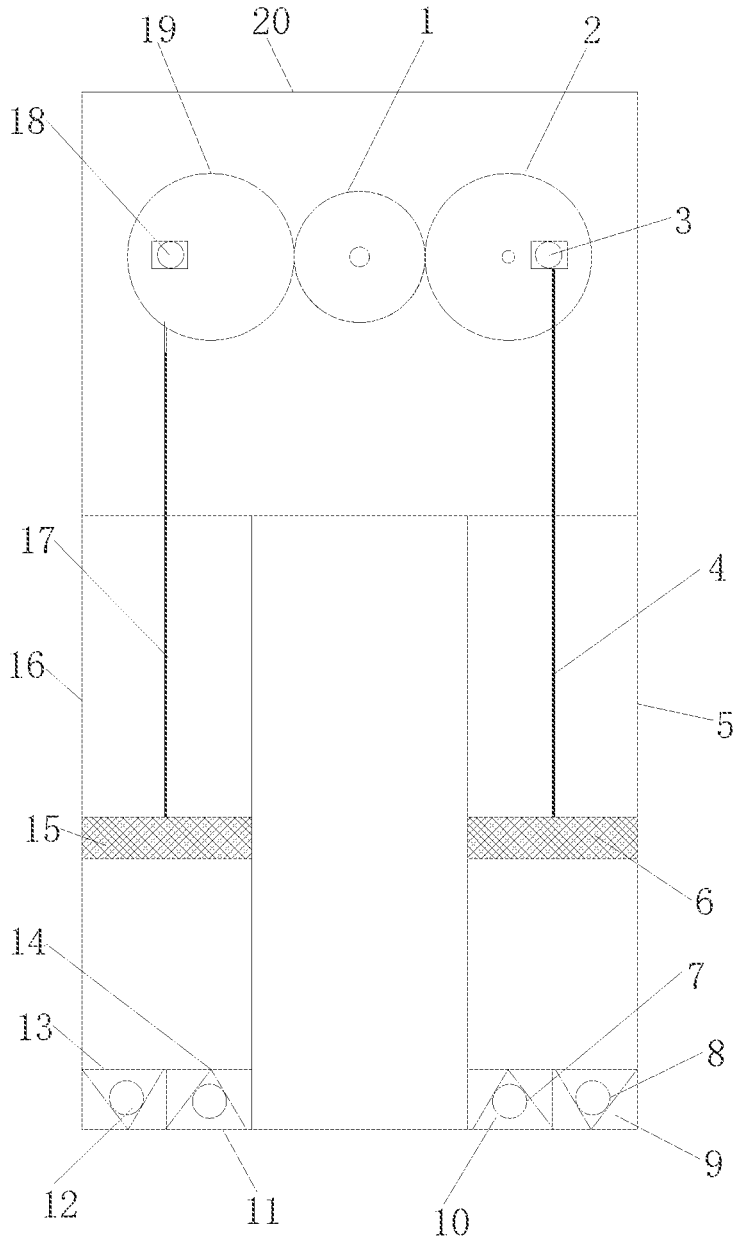
FIG. 1 is a schematic diagram I of a principle of a clothes treatment agent release device according to an embodiment of the present disclosure.
Figure 2:
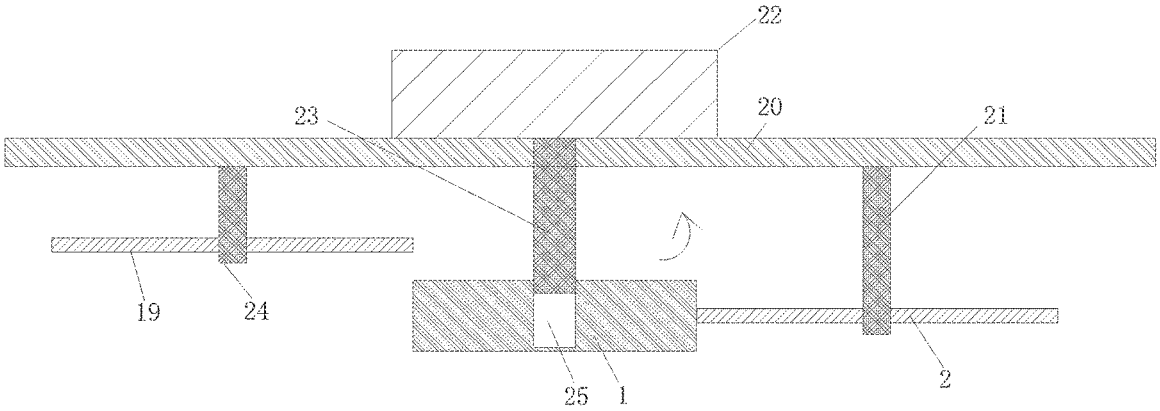
FIG. 2 is a schematic diagram II of a principle of a clothes treatment agent release device according to an embodiment of the present disclosure.
Figure 3:
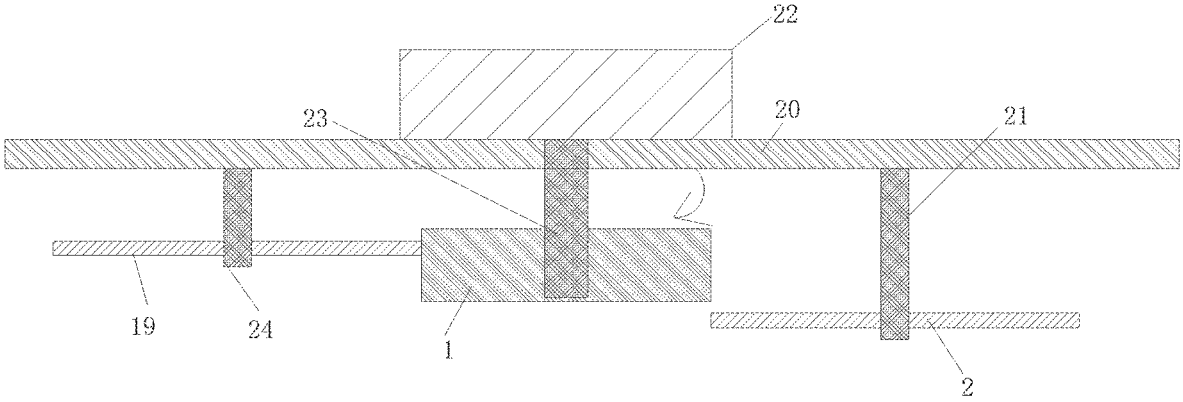
FIG. 3 is a schematic diagram III of a principle of a clothes treatment agent release device according to an embodiment of the present disclosure.

As shown in FIG. 1 to FIG. 3, a clothes treatment agent release device according to an embodiment includes:

a storage cavity in which a clothes treatment agent is stored;

a release cavity provided with a liquid outlet and a liquid inlet communicating with the storage cavity, a liquid inlet one-way turn-on part being arranged at the liquid inlet, and a liquid outlet one-way turn-on part being arranged at the liquid outlet;

a piston mechanism arranged in the release cavity in a reciprocating motion mode; and a driving mechanism connected with the piston mechanism; wherein the driving mechanism drives the piston mechanism to do reciprocating motion in the release cavity, the liquid inlet one-way turn-on part/the liquid outlet one-way turn-on part respectively and unidirectionally turns on the liquid inlet/the liquid outlet in the reciprocating motion process of the piston mechanism, and the clothes treatment agent in the storage cavity is sucked into the release cavity from the liquid inlet, and discharged and released from the liquid outlet.

The clothes treatment agent release device according to the embodiment drives the piston mechanism to do reciprocating motion in the release cavity by the driving mechanism so as to release the clothes treatment agent in the release cavity, adopts a principle different from that of an existing automatic detergent release device, is simple in structure and low in cost, promotes user experience, and has a wide market prospect.

In order to solve transmission connection between the driving mechanism and the piston mechanism, as an implementation mode of the embodiment, according to the embodiment, the piston mechanism includes a piston and a piston rod; the driving mechanism includes a driving part and a driven part, the driven part is respectively in transmission connection with the driving part and the piston rod, and the driven part converts rotation of the driving part into the reciprocating motion of the piston in the release cavity; and the driving part in the embodiment can drive the piston mechanism to move by the driven part, so that the driven part can convert rotation of the driving part into the linear reciprocating motion of the piston mechanism.

Alternatively, the driving mechanism is provided with a driving end capable of reciprocating motion, and the driving end is connected with the piston rod to drive the piston to do reciprocating motion in the release cavity; and according to the embodiment, a linear motor can be selected as the driving mechanism to directly drive the piston mechanism to do reciprocating motion.

Further, the driven part includes a driven wheel, one end of the piston rod of the piston mechanism is eccentrically and rotatably connected with the driven wheel, the other end of the piston rod of the piston mechanism is connected with the piston, the driving part drives the driven wheel to rotate, and the driven wheel drives the piston to do reciprocating motion in the release cavity by the piston rod; and the driving part is provided with a rotating end, and the rotating end is connected with the driven wheel to drive the driven wheel to rotate; or, the driving part includes a driving motor and a driving gear connected with the driving motor, the driven wheel is a driven gear, and the driving gear is in engaged transmission with the driven gear.

As shown in FIG. 1 to FIG. 3, according to this embodiment, the release cavity includes a first release cavity 5 for releasing one type of clothes treatment agent and a second release cavity 16 for releasing another type of clothes treatment agent, a first piston mechanism (4, 6) is arranged in the first release cavity 5, and a second piston mechanism (15, 17) is arranged in the second release cavity 16; the driven part includes a first driven part in transmission connection with the first piston mechanism and a second driven part in transmission connection with the second piston mechanism; and the driving part is optionally in transmission connection with the first driven part or the second driven part to release the clothes treatment agent in the first release cavity or the second release cavity.

According to the embodiment, the clothes treatment agents in the two release cavities are released by one set of driving mechanism, so that the integral structure is simplified, and the manufacturing cost is reduced.

Further, the driving part includes the driving motor 22 and the driving gear 1 connected with the driving motor 22, the first driven part includes a first driven gear 2, the second driven part includes a second driven gear 19, one end of a piston rod 4 of the first piston mechanism (4, 6) is eccentrically and rotatably connected with the first driven gear 2, and one end of a piston rod 17 of the second piston mechanism (15, 17) is eccentrically and rotatably connected with the second driven gear 19; and the driving gear 1 can move to be in engaged transmission with the first driven gear 2 or in engaged transmission with the second driven gear 19 so as to release the clothes treatment agent in the first release cavity 5 or the second release cavity 16.

The first release cavity 5 and the second release cavity 16 are respectively used for releasing different types of clothes treatment agents, for example, the first release cavity 6 is used for releasing a detergent and the second release cavity 16 is used for releasing a fabric softener, and thus, the first release cavity and the second release cavity are different in release time of the clothes treatment agents; and the two release cavities are driven by the same driving mechanism to carry out release, but are also required to not influence each other, and thus, the driving gear 1 can move to be in engaged transmission with the first driven gear 2 or in engaged transmission with the second driven gear 19.

Specifically, according to the embodiment, the first driven gear 2 and the second driven gear 19 are arranged at intervals in a horizontal direction, and are arranged up and down in a vertical direction; and the driving gear 1 is arranged in an up-and-down movable mode between the first driven gear 2 and the second driven gear 19, and the driving gear 1 moves up and down to be respectively in engaged transmission with the first driven gear 2 and the second driven gear 19.

In order to implement the up-and-down motion of the driving gear 1, as an implementation mode of the embodiment, a connection screw 23 is arranged at an output end of the driving motor 22, the center of the driving gear 1 is provided with a threaded hole 25 in threaded connection with the connection screw 23, and the connection screw 23 drives the driving gear 1 to move up and down in the vertical direction to be respectively in engaged transmission with the first driven gear 2 and the second driven gear 19.

According to the embodiment, the clothes treatment agent release device includes a shell; the shell is internally provided with the first release cavity 5, the second release cavity 16 and a mounting cavity 20, the driving part, the first driven gear 2 and the second driven gear 19 are arranged in the mounting cavity 20, and one end of the piston rod 4 of the first piston mechanism (4, 6) is connected with a piston 6, and the other end of the piston rod 4 of the first piston mechanism (4, 6) extends into the mounting cavity 20 to be eccentrically and rotatably connected with the first driven gear 2; one end of the piston rod 17 of the second piston mechanism (15, 17) is connected with a piston 15, and the other end the piston rod 17 of the second piston mechanism (15, 17) extends into the mounting cavity 20 to be eccentrically and rotatably connected with the second driven gear 19; the first release cavity 5 is provided with a first liquid inlet 9 and a first liquid outlet 10, a first liquid inlet one-way valve 7 is arranged at the first liquid inlet 9, and a first liquid outlet one-way valve 8 is arranged at the first liquid outlet 10; and the second release cavity 16 is provided with a second liquid inlet 12 and a second liquid outlet 11, a second liquid inlet one-way valve 13 is arranged at the second liquid inlet 12, and a second liquid outlet one-way valve 14 is arranged at the second liquid outlet 11.

According to the embodiment, a first rotation shaft 21 and a second rotation shaft 24 are arranged in the mounting cavity 20, the first driven gear 2 is rotatably mounted on the first rotation shaft 21, and the second driven gear 19 is rotatably mounted on the second rotation shaft 24.

According to the embodiment, a first connection pillar 3 is eccentrically arranged on the first driven gear 2, and the piston rod 4 of the first piston mechanism is rotatably mounted on the first connection pillar 3; and a second connection pillar 18 is eccentrically arranged on the second driven gear 19, and the piston rod 17 of the second piston mechanism is rotatably mounted on the second connection pillar 18. Therefore, conversion from rotation of the driven gear to the linear reciprocating motion of the piston mechanism is realized.

An embodiment further provides a washing machine with the clothes treatment agent release device, including a detergent box, wherein the liquid outlet of the clothes treatment agent release device communicates with the detergent box.

According to an embodiment, a control method of a washing machine includes: in a water inflow process of the washing machine, controlling a driving mechanism to drive a piston mechanism to do reciprocating motion in a release cavity, respectively and unidirectionally turning on a liquid inlet/a liquid outlet in the reciprocating motion process of the piston mechanism by a liquid inlet one-way turn-on part/a liquid outlet one-way turn-on part, sucking a clothes treatment agent in a storage cavity into the release cavity from the liquid inlet, and discharging and releasing the clothes treatment agent from the liquid outlet.

According to the embodiment, a driving motor of the driving mechanism can rotate forwards and reversely, and different types of clothes treatment agents in a first release cavity and a second release cavity are controlled to be released at different time by controlling forward and reverse rotation of the driving motor.

According to the embodiment, a control system of the washing machine drives the driving gear to rotate forwards by controlling the driving motor to rotate forwards, the driving gear drives the first driven gear to run, the first driven gear is provided with the first connection pillar connected with the piston rod of the piston mechanism, the first driven gear drives the piston of the piston mechanism to do reciprocating motion in the first release cavity, the first release cavity is provided with the first liquid inlet and the first liquid outlet, and the first liquid inlet one-way valve and the first liquid outlet one-way valve are arranged to release one type of clothes treatment agent, for example, the first release cavity is used for releasing the detergent, so that the control system controls the driving motor to rotate forwards in a water inflow stage of a washing procedure to carry out release.

According to the embodiment, the control system of the washing machine drives the driving gear to rotate reversely by controlling the driving motor to rotate reversely, the driving gear drives the second driven gear to run, the second driven gear is provided with the second connection pillar connected with the piston rod of the piston mechanism, the second driven gear drives the piston of the piston mechanism to do reciprocating motion in the second release cavity, the second release cavity is provided with the second liquid inlet and the second liquid outlet, and the second liquid inlet one-way valve and the second liquid outlet one-way valve are arranged to release another type of clothes treatment agent, for example, the second release cavity is used for releasing the fabric softener, and the control system controls the driving motor to rotate reversely in a water inflow stage of a final rinsing procedure to carry out release.

Further, clothes can be weighed after being put into an inner tub, a release quantity of the clothes treatment agent is determined according to the weight of the clothes, and a clothes treatment device is controlled to carry out quantitative release according to the release quantity.

Alternatively, a user can select a quantity of the clothes treatment agent to be released, and the clothes treatment device is controlled according to selection of the user to carry out quantitative release according to the release quantity.

The foregoing embodiments merely are preferred embodiments of the present disclosure, but do not make any limit to the present disclosure in any form. Although the present disclosure has been disclosed above with preferred embodiments, the present disclosure is not limited thereto. Those skilled in the art, without departure from the scope of the technical solutions of the present disclosure, can make some changes or modifications to form equivalent embodiments with equivalent variations by utilizing the technical contents prompted above, and any simple changes, equivalent variations and modifications made to the above embodiments according to the technical essence of the present disclosure without departure from the contents of the technical solutions of the present disclosure shall fall within the scope of the solutions of the present disclosure.

The invention claimed is:

1. A clothes treatment agent release device, comprising:

a storage cavity for storing a clothes treatment agent;

a release cavity being provided with a liquid outlet and a liquid inlet communicating with the storage cavity, a liquid inlet one-way valve being arranged at the liquid inlet, and a liquid outlet one-way valve being arranged at the liquid outlet;

a piston mechanism being arranged in the release cavity configured to operate in a reciprocating motion mode; and a driving mechanism being connected with the piston mechanism; wherein the driving mechanism is configured to drive the piston mechanism to do reciprocating motion in the release cavity, the liquid inlet one-way valve or the liquid outlet one-way valve respectively and unidirectionally configured to turn on the liquid inlet or the liquid outlet in the reciprocating motion of the piston mechanism for sucking clothes treatment agent in the storage cavity into the release cavity from the liquid inlet, and for discharging and releasing from the liquid outlet, the piston mechanism includes a piston and a piston rod;

the driving mechanism includes a driving part and a driven part, the driven part is respectively in transmission connection with the driving part and the piston rod, and the driven part is configured to convert rotation of the driving part into reciprocating motion of the piston in the release cavity; or, the driving mechanism is provided with a driving end configured for reciprocating motion, and the driving end is connected with the piston rod for driving the piston to do reciprocating motion in the release cavity;

the release cavity includes a first release cavity for releasing a first clothes treatment agent and a second release cavity for releasing a second clothes treatment agent, the piston mechanism includes a first piston mechanism arranged in the first release cavity, and a second piston mechanism arranged in the second release cavity;

the driven part includes a first driven part in transmission connection with the first piston mechanism and a second driven part in transmission connection with the second piston mechanism, and the driving part is optionally in transmission connection with the first driven part or the second driven part to release the clothes treatment agent in the first release cavity or the second release cavity;

the driving part includes a driving motor and a driving gear connected with the driving motor, the first driven part includes a first driven gear, the second driven part includes a second driven gear, one end of a piston rod of the first piston mechanism is eccentrically and rotatably connected with the first driven gear, and one end of a piston rod of the second piston mechanism is eccentrically and rotatably connected with the second driven gear; and the driving gear is configured to move to be in engaged with the first driven gear or in engaged with the second driven gear so as to release the clothes treatment agent in the first release cavity or the second release cavity;

the first driven gear and the second driven gear are arranged at intervals in a horizontal direction, and are arranged up and down in a vertical direction; and the driving gear is arranged in an up-and-down movable mode between the first driven gear and the second driven gear, and the driving gear moves up and down to be respectively in engaged transmission with the first driven gear or the second driven gear; and a connection screw is arranged at an output end of the driving motor, a center of the driving gear is provided with a threaded hole in threaded connection with the connection screw, and the connection screw is configured to drive the driving gear to move up and down in a vertical direction to be respectively engaged with the first driven gear or the second driven gear.

2. The clothes treatment agent release device according to claim 1, wherein each driven part comprises a driven wheel, one end of the piston rod of each piston mechanism is eccentrically and rotatably connected with the driven wheel, while an other end of the piston rod of the piston mechanism is connected with the piston, the driving part drives is configured to drive the driven wheel to rotate, and the driven wheel drives the piston to do reciprocating motion in the release cavity by the piston rod; and the driving part is provided with a rotating end, and the rotating end is connected with the driven wheel for driving the driven wheel to rotate; or the driving part includes a driving motor and a driving gear connected with the driving motor, the driven wheel is a driven gear, and the driving gear is in engaged transmission with the driven gear.

3. The clothes treatment agent release device according to claim 1, comprising the first release cavity, the second release cavity and a mounting cavity; the driving part, the first driven gear and the second driven gear are arranged in the mounting cavity, and one end of the piston rod of the first piston mechanism is connected with the piston of the first piston mechanism, and an other end of the piston rod of the first piston mechanism extends into the mounting cavity to be eccentrically and rotatably connected with the first driven gear; one end of the piston rod of the second piston mechanism is connected with the piston of the second piston mechanism, and an other end of the piston rod of the second piston mechanism extends into the mounting cavity to be eccentrically and rotatably connected with the second driven gear; the first release cavity is provided with a first liquid inlet and a first liquid outlet, a first liquid inlet one-way valve is arranged at the first liquid inlet, and a first liquid outlet one-way valve is arranged at the first liquid outlet; and the second release cavity is provided with a second liquid inlet and a second liquid outlet, a second liquid inlet one-way valve is arranged at the second liquid inlet, and a second liquid outlet one-way valve is arranged at the second liquid outlet.

4. A washing machine comprising:

the clothes treatment agent release device according to claim 1; and a detergent box, a liquid outlet of the clothes treatment agent release device communicating with the detergent box.

5. A control method of a washing machine including a storage cavity for storing a clothes treatment agent;

a release cavity being provided with a liquid outlet and a liquid inlet communicating with the storage cavity, a liquid inlet one-way valve being arranged at the liquid inlet, and a liquid outlet one-way valve being arranged at the liquid outlet;

a piston mechanism being arranged in the release cavity configured to operate in a reciprocating motion mode; and a driving mechanism being connected with the piston mechanism; wherein the driving mechanism is configured to drive the piston mechanism to do reciprocating motion in the release cavity, the liquid inlet one-way valve or the liquid outlet one-way valve respectively and unidirectionally configured to turn on the liquid inlet or the liquid outlet in the reciprocating motion of the piston mechanism for sucking clothes treatment agent in the storage cavity into the release cavity from the liquid inlet, and for discharging and releasing from the liquid outlet, the piston mechanism includes a piston and a piston rod;

the driving mechanism includes a driving part and a driven part, the driven part is respectively in transmission connection with the driving part and the piston rod, and the driven part is configured to convert rotation of the driving part into reciprocating motion of the piston in the release cavity; or, the driving mechanism is provided with a driving end configured for reciprocating motion, and the driving end is connected with the piston rod for driving the piston to do reciprocating motion in the release cavity;

the release cavity includes a first release cavity for releasing a first clothes treatment agent and a second release cavity for releasing a second clothes treatment agent, the piston mechanism includes a first piston mechanism arranged in the first release cavity, and a second piston mechanism arranged in the second release cavity;

the driven part includes a first driven part in transmission connection with the first piston mechanism and a second driven part in transmission connection with the second piston mechanism, and the driving part is optionally in transmission connection with the first driven part or the second driven part to release the clothes treatment agent in the first release cavity or the second release cavity;

the driving part includes a driving motor and a driving gear connected with the driving motor, the first driven part includes a first driven gear, the second driven part includes a second driven gear, one end of a piston rod of the first piston mechanism is eccentrically and rotatably connected with the first driven gear, and one end of a piston rod of the second piston mechanism is eccentrically and rotatably connected with the second driven gear; and the driving gear is configured to move to be in engaged with the first driven gear or in engaged with the second driven gear so as to release the clothes treatment agent in the first release cavity or the second release cavity;

the first driven gear and the second driven gear are arranged at intervals in a horizontal direction, and are arranged up and down in a vertical direction; and the driving gear is arranged in an up-and-down movable mode between the first driven gear and the second driven gear, and the driving gear moves up and down to be respectively in engaged transmission with the first driven gear or the second driven gear; and a connection screw is arranged at an output end of the driving motor, a center of the driving gear is provided with a threaded hole in threaded connection with the connection screw, and the connection screw is configured to drive the driving gear to move up and down in a vertical direction to be respectively engaged with the first driven gear or the second driven gear; and a detergent box, a liquid outlet of the clothes treatment agent release device communicating with the detergent box, the method comprising:

in a water inflow process of the washing machine, the driving mechanism being controlled to drive the piston mechanism to do reciprocating motion in the release cavity, the liquid inlet or the liquid outlet being turned on respectively and unidirectionally in the reciprocating motion process of the piston mechanism by the liquid inlet one-way valve or the liquid outlet one-way valve, at least one of the first clothes treatment agent and the second clothes treatment agent in the storage cavity being sucked into the release cavity from the liquid inlet, and the at least one of the first clothes treatment agent and the second clothes treatment agent being discharged and released from the liquid outlet.

* * * * *